United States Patent [19]

Oberg

[11] 4,261,735

[45] Apr. 14, 1981

[54] INJECTION-METALLURGICAL PROCESS

[75] Inventor: Karl E. Oberg, Viken, Sweden

[73] Assignee: Scandinavian Lancers Aktiebolag, Hoganas, Sweden

[21] Appl. No.: 132,529

[22] Filed: Mar. 21, 1980

[30] Foreign Application Priority Data

Apr. 30, 1979 [SE] Sweden ..... 7903783

[51] Int. Cl.[3] ..... C21C 7/00; C21C 7/02

[52] U.S. Cl. ..... 75/53; 75/58

[58] Field of Search ..... 75/53, 58

[56] References Cited

U.S. PATENT DOCUMENTS 4,121,923 10/1978 Gruner ..... 75/58

4,137,072 1/1979 Kawakami ..... 75/58

4,180,397 12/1979 Naylor ..... 75/58

*Primary Examiner*—P. D. Rosenberg

*Attorney, Agent, or Firm*—Murray and Whisenhunt

[57] ABSTRACT

In an injection-metallurgical process performed in a ladle, lime is injected during a first phase after the deoxidation, removing the main part of the sulphur existing in the melt. During a second phase thereafter calcium-silicon, calcium-carbide or calcium-cyanamide is injected, which has a devised impact upon the morphology of the remaining inclusions. At the same time the flowability of the steel is improved, which is particularly important in the production of deep-drawing steels.

13 Claims, 2 Drawing Figures of the steel. Normally the first injection phase is completed before the second phase is begun, but it is also possible to let the injection phases partly overlap each other, so that during an intermediate phase a mixture of the respective calcium-containing compounds is injected, which can facilitate the technological performance of the process. It is also possible during the whole of the second injection phase to let the injected material contain a certain percentage of lime in addition to the material containing said non-oxidically combined calcium.

As a carrier gas there is used a neutral gas, such as argon or nitrogen. Suitably the injection is performed in a ladle with basic lining, and before the injection starts the melt in a manner known per se suitably is covered with a basic slag.

According to the preferred embodiment of the invention, the well deoxidized melt contains min. 0.02% sulphur, which during the first injection phase is reduced to below 0.01%, essentially through the supply of lime, while during the second injection phase between 0.05 and 0.5 kg calcium per ton steel is supplied substantially in the form of non-oxidically combined calcium which further reduces the sulphur content to max. 0.005%. At the same time a substantial spheroidization of remaining sulphidic inclusions takes place, while aluminium oxides in the melt is reduced by freed calcium to forms which have not the tendency typical for aluminium oxides to hitch to each other to form large aggregates.

The non-oxidically combined calcium which is injected as a powder during the second injection phase is suitably supplied in the form of at least one of the compounds belonging to the group consisting of calcium-silicon (CaSi), calcium-carbide ($CaC_2$), and calcium-cyanamide ($CaCN_2$). Calcium-silicon, suitably normal commercial grade calcium-silicon, suitably is chosen in the production of steels containing min 0.1% Si and max 0.1% C. Calcium carbide is the material among the three mentioned compounds which in the normal case is used during the second injection phase. In other words calcium-carbide is a preferable main calcium carrier during the second injection phase in the production of steel containing more than 0.1% C.

In the production of deep-drawing steel containing max 0.1% C and max 0.08% Si (preferably mas 0.05% Su), calcium is supplied during the second injection phase substantially in the form of calcium-carbide and/or calcium caynamide, preferably in the form of calcium-cyanamide which can bring about a certain grain refining effect due to its content of nitrogen.

EXAMPLES

Example 1

In this example, which illustrates conventional praxis, a steel melt was decarburized and tapped into a ladle. At the same tame alloying elements and a deoxidizing agent (aluminium) was added. The charge weight was 42 tons, and the steel was of a standard carbon-manganese grade (0.17 C; 1.4 Mn). The surface of the steel melt was covered by lime, CaO, to obtain a basic slag. Thereafter calcium-silicon, CaSi, was injected by means of a lance submerged into the steel melt. Argon was used as a carrier gas. Every second minute samples were taken of silicon, sulphur, and calcium. The following values were recorded. The percentages refer to weight-%.

TABLE 1

| Sample | Minute | Totaly added CaSi Kg/ton | Si % | S % | Ca % |
|---|---|---|---|---|---|
| I | 0 | 0 | .16 | .014 | .0007 |
| II | 2 | 1,2 | .23 | .011 | .0471 |
| III | 4 | 2,4 | .25 | .008 | .0288 |
| IV | 6 | 3,6 | .29 | .006 | .0209 |
| Final sample during casting | ca 30 | 3,6 | .30 | .004 | .0070 |

Figure 1:
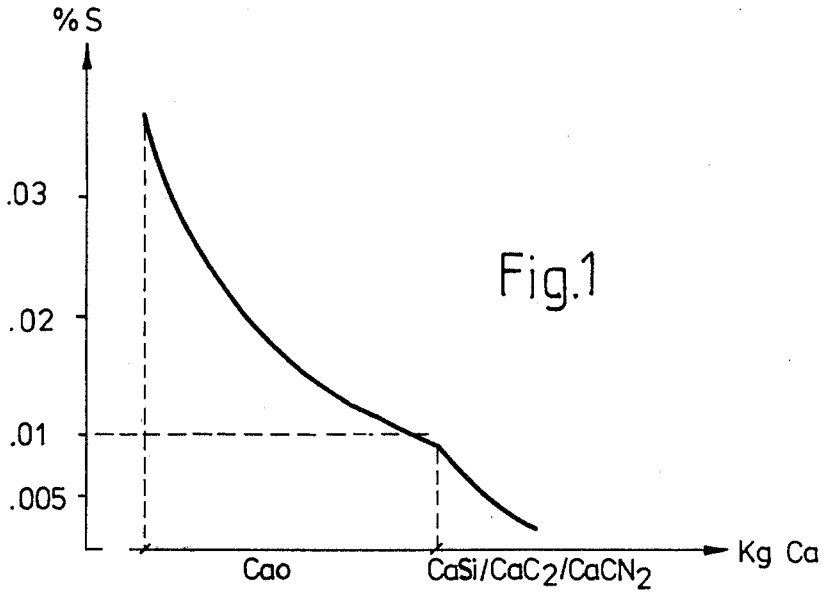
FIG. 1 illustrates in the form of a schematic chart the principles for the development of the injection according to the invention.
Figure 2:
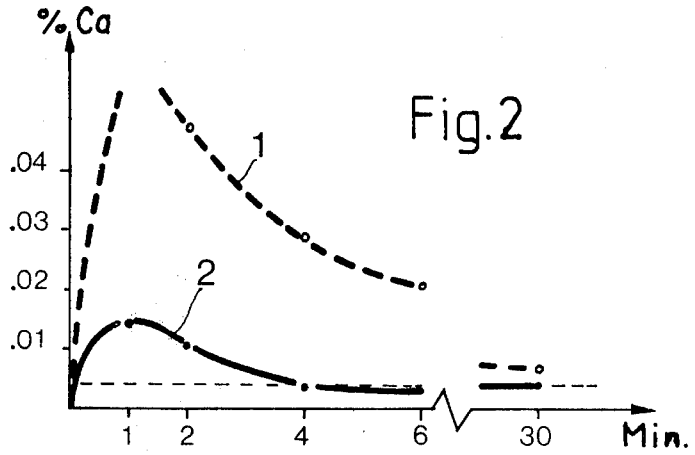
FIG. 2 in the form of a diagram illustrates the development of the calcium content in a steel melt according to conventional injection practice, and according to the invention, respectively.

The calcium content in the steel melt is represented in diagram 1 in FIG. 2 as a function of time.

Example 2

This example relates to a stainless steel melt, grade AISI 316 LN, having a charge weight of 60 tons. After decarburization the composition of the melt was adjusted, the steel melt was deoxidized and tapped in the same ladle as was used in Example 1. The melt also in this case was covered with a basic slag. Lime, CaO, was injected until the sulphur content hade been reduced to 0.006%. Thereafter calcium-silicon, CaSi, was injected. Samples were taken according to table 2.

TABLE 2

| Sample | Minute | Totaly added CaSi Kg/ton | Si % | S % | Ca % |
|---|---|---|---|---|---|
| I | 0 | 0 | .39 | .006 | .0001 |
| II | 1 | 0,4 | .45 | .006 | .0143 |
| III | 2 | 0,8 | .48 | .006 | .0104 |
| IV | 4 | 1,6 | .52 | .005 | .0035 |
| Final sample during casting | ca 30 | 1,6 | .55 | .005 | .0040 |

Examples 1 and 2 illustrate that it is possible according to the invention to achieve desired morphologic transformation. The fact that the total calcium content in the steel remains low and is reduced during the performance of the injection namely is an indication that the morphologic transformation is obtained. These two conditions are obtained in Example 2, curve 2 in the diagram in FIG. 2, but not in Example 1, where curve 1 in the diagram is raised to calcium contents far above the limit of solubility of calcium in the steel melt. In the diagram the dashed line indicates the approximative limit of solubility for calcium in molten steel.

A comparison between conventional practice according to Example 1 and according to the invention, Example 2, also envisages that only fairly small contents of CaSi are required for the achievement of the desired result. Particularly it should be observed in the diagram that the desired result as a matter of fact is achieved already after the injection of about 0.8 kg CaSi/ton and that those further 0.8 kg CaSi/ton which were added can be considered as superfluous.

I claim:

1. Injection-metallurgical process for the treatment of a deoxidized steel melt, said process comprising first

INJECTION-METALLURGICAL PROCESS

TECHNICAL FIELD

The present invention relates to an injection-metallurgical process for the treatment of a steel melt. More particularly the invention relates to a process comprising the injection of powdered calcium-compounds into a melt.

TECHNICAL BACKGROUND

In the development of more and more improved steel grades, the interest has been concentrated upon the non-metallic inclusions which always exist in steel and which frequently may influence the workability of the steel in a most drastic way and also have a great impact upon its mechanical properties. As well oxidic as sulphidic inclusions may have effect byt in view of the low oxygen content in well killed steels it is natural that the greatest efforts have been concentrated upon the sulphidic inclusions. One has therefore aimed at reducing as well the total content of sulphur in the melt and hence the amount of sulphides, as transforming the remaining sulphides to make them as harmless as possible. To that end one has tried to affect the morphology so that long "worm-like" sulphidic inclusions be transformed to adopt a more spheroidal shape which with reference to the workability of the steel through rolling, forging etc. as well as to its mechanical properties in different directions are more more harmless than the more elongated inclusions.

A particular problem-fields is those low-carbon- and low-silicon aluminium-killed steels which in very great quantities are used in the form of cold-rolled sheet because of the excellent mechanical deep-drawing properties of these steels. A typical range of application is deep-drawing-sheets for motor-car bodies. The fact that these steels may be massproduced at low costs. One way to reduce the production costs is to utilize continuous casting technic. Continuous casting of aluminum killed, low-carbon- and low-silicon steels in practise, however is difficult or impossible to perform due to a number of cooperating factores. Thus the flowility is low, at the same time as large aggregates of aluminium oxides, $Al_2O_3$, frequently block the continuous casting nozzles. Therefore one has mainly been thrown upon conventional ingot casting for the production of aluminium killed deep-drawing steels.

However, continuous casting has become the quite dominating method for the production of most other commercial steel grades. For desulphurization purposes and for composition adjustments it has become increasingly frequent to treat the steel melts injection-metallurgically in a ladle. Most of these injection-metallurgical methods have in common that a controlled quantity of a calcium compound, e.g. lime, calcium-carbide and/or calcium-silicon, is injected into the deoxidized steel melt by means of a neutral carrier gas, possibly together with a fluxing agent, such as fluorspar, $CaF_2$, e.g. as is described in Stahl u. Eisen (1974), No. 11, P 474–485. The desulphurization result basically depends on the total quantity of calcium supplied to the melt, said calcium combining with sulphur existing in the melt to form calcium sulphide, CaS, which is collected in the slag on the surface of the melt, but is substantially independent of which kind of calcium compound that is used. However it has been considered necessary that the supplied mixture contains a high percentage of calcium that is not combined in oxidic form. Such calcium, as distinguished from calcium in the form of lime, may be freed as elementary calcium and in that form be dissolved into the melt and/or react with the inclusions in the melt. This gives the ground for the possible achievement of the desired result as far as the morphology of the inclusions is concerned. At the same time the flowability of the steel is improved through the dissolving of calcium into the melt. Therefore it is a common practice to supply a mixture of calcium compounds which up to fifty percent, or more, consists of calcium-silicon or calcium-carbide, $CaC_2$, notwithstanding calcium-silicon is about twenty times more expensive than lime. The treatment in other words is comparatively expensive. In the production of low-carbon steels, however even the theoretical possibility of supplying large quantities of calcium-carbide must be neglected because of the recarburization effect. Particularly in the production of deep-drawing steels it is nor possible to supply calcium-silicon in the same way in view of the fact that only very low silicon contents are tolerated in these steels. Nor can mixtures of lime and such an agent as calcium-cyanamide, $CaCN_2$, a mixture which has been proposed for the desulphurization of steel, according to known technique be used for the treatment of particularly deep-drawing steels because of the recarburization effect.

DISCLOSURE OF THE INVENTION

The invention aims at offering an injection-metallurgical process for the treatment of a steel melt, in which process the above mentioned drawbacks and limitations of prior art injection-metallurgy substantially has been eliminated.

More particularly it is an object of the invention to reduce the costs for the treatment of steel melts, at the same time as at least as good desulphurization and morphologic transformation of remaining inclusions can be achieved as through known methods which are based on the treatment with lime (CaO) and a compound in which kalcium is not bound in oxidic form, such as calcium-silicon (SaSi), calcium-carbide ($CaC_2$), and calcium-cyanamide ($CaCN_2$).

Further it is an object, particularly in the production of deep-drawing steels, i.e. aluminium-killed steels with low carbon and silicon contents, to produce a steel melt with properties suitable for continuous casting. This means in the first place that the sulphidiz inclusions be transformed to essentially spherical shape.

Further normally existing aluminium oxides, $Al_2O_3$, preferably should be essentially transformed into spheroidal complex calcium aluminates which have not the same tendency as $Al_2O_3$ has to combine to form large aggregates.

According to the invention lime, CaO, in a first phase after deoxidation of the steel melt is injected in the form of a powder, possibly together with fluorspar, $CaF_2$, by means of a neutral carrier gas beneath the surface of the melt, such quantity of lime being supplied that the amount of supplied calcium be sufficient for the removal of the majority of sulphur existing in the melt. In a second phase thereafter, non-oxidically combined calcium is injected, said calcium essentially being freed as elementary calcium and in that form dissolving into the melt and/or reacting with remaining inclusions, essentially transforming said inclusions to harmless inclusions, and at the same time improving the flowability removing the majority of sulfur existing in the deoxidized steel melt by injecting calcium oxide by means of a neutral carrier gas beneath the surface of said melt in an amount sufficient to remove said majority of sulfur in said melt, and after at least a portion of said majority of said sulfur has been removed transforming the inclusions in said melt to harmless inclusions, while improving the flowability of the steel, by injecting non-oxidically combined calcium into the melt to essentially free said calcium as elementary calcium to dissolve into the melt and transform said inclusions into harmless inclusions.

2. Process of claim 1, wherein fluorospar, $CaF_2$, is injected together with the calcium oxide.

3. Process according to claim 1, wherein the calcium oxide injection phase is completed before the non-oxidically combined calcium injection phase is begun.

4. Process according to claim 1, wherein the non-oxidically combined calcium injection phase partly overlaps the calcium oxide injection phase, so that during an intermediate phase a mixture of the respective calcium compounds is injected.

5. Process according to any one of claims 1, 2 or 3, wherein the deoxidized steel melt contains a minimum of about 0.02% sulfur, which is reduced during the calcium oxide injection phase to a level of less than 0.01%, and during the non-oxidically combined calcium injection phase between 0.05 and 0.5 kg of calcium/ton of steel is supplied in the form of said non-oxidically combined calcium.

6. Process according to claim 5, wherein during the non-oxidically combined calcium injection phase the sulfur content of the steel melt is further reduced to a maximum of 0.005%.

7. Process according to any one of claims 1, 2, 3 or 4, wherein the non-oxidically combined calcium is in the form of a compound selected from the group consisting of calcium-silicon, calcium-carbide and calcium-cyanamide.

8. Process according to claim 7, wherein calcium-silicon is injected during the non-oxidically combined calcium injection phase.

9. Process of claim 8, wherein the steel produced by said process contains a minimum of 0.1% Si and a maximum of 0.1% C.

10. Process according to claim 7, wherein calcium-carbide is injected into the steel melt during the non-oxidically combined calcium injection phase, and the resulting steel contains more than 0.1% C.

11. Process according to claim 7, wherein calcium-cyanamide is injected into the steel melt during the non-oxidically combined calcium injection phase to produce a steel containing a maximum of 0.1% C and a maximum of 0.08% Si.

12. Process according to claim 11, wherein the resulting steel contains a maximum of 0.05% Si.

13. Process of claim 7, wherein the steel produced by said process is a low carbon, low silicon deep drawing steel suitable for continuous casting.

* * * * *